US009133753B2

(12) United States Patent
Vollmer et al.

(10) Patent No.: US 9,133,753 B2
(45) Date of Patent: Sep. 15, 2015

(54) MUFFLER HAVING COUPLING OF A TAILPIPE BY MEANS OF A COUPLING CHAMBER

(71) Applicant: TENNECO GMBH, Edenkoben (DE)

(72) Inventors: Christoph Vollmer, Lustadt (DE); Stefan Schwarzwälder, Landau (DE)

(73) Assignee: TENNECO GMBH, Edenkoben (DE)

( * ) Notice: Subject to any disclaimer, the term of this patent is extended or adjusted under 35 U.S.C. 154(b) by 0 days.

(21) Appl. No.: 14/387,375

(22) PCT Filed: Mar. 27, 2013

(86) PCT No.: PCT/EP2013/056548

§ 371 (c)(1),
(2) Date: Sep. 23, 2014

(87) PCT Pub. No.: WO2013/149912

PCT Pub. Date: Oct. 10, 2013

(65) Prior Publication Data

US 2015/0047922 A1 Feb. 19, 2015

(30) Foreign Application Priority Data

Apr. 2, 2012 (DE) ..... 10 2012 006 544

(51) Int. Cl.
*F01N 1/02* (2006.01)
*F01N 1/04* (2006.01)
(Continued)

(52) U.S. Cl.
CPC ..... *F01N 13/001* (2013.01); *F01N 1/003* (2013.01); *F01N 1/24* (2013.01); *F01N 2340/00* (2013.01);
(Continued)

(58) Field of Classification Search
USPC ..... 181/264, 251, 250, 268, 272, 273, 275, 181/238, 239, 227, 267, 252, 256
See application file for complete search history.

(56) References Cited

U.S. PATENT DOCUMENTS 2,039,800 A * 5/1936 Jack ..... 181/252
2,520,756 A * 8/1950 Bryant ..... 181/269
(Continued)

FOREIGN PATENT DOCUMENTS

DE 2 048 437 4/1972
DE 3837677 A1 * 6/1989 ..... F01N 1/04
(Continued)

*Primary Examiner* — Edgardo San Martin
(74) *Attorney, Agent, or Firm* — Hudak, Shunk & Farine Co. LPA

(57) ABSTRACT

A muffler for an exhaust system of an internal combustion engine having a housing wall, having a muffler housing with at least one inlet pipe guided through the housing wall and at least one outlet pipe guided through the housing wall, wherein the inlet pipe has at least one outflow opening via which the exhaust gas can flow from the inlet pipe into the outlet pipe, whereby, within the muffler housing, at least one coupling chamber with a chamber wall is provided with a center axis, which forms a flow channel between the inlet pipe and the outlet, whereby the chamber wall encloses the inlet pipe or the outlet pipe in the receiving direction E1 with respect to the center axis and is connected only indirectly via the inlet pipe and the outlet pipe or a muffler housing intermediate wall in a form- or material-fitting manner to the housing wall, whereby the chamber wall of the coupling chamber has a diameter D and whereby the exhaust pipe has an outer diameter d, whereby for the ratio of D/d, 20/10>–D/d>=11/10 or 18/10>=D/d>=11/10 is valid.

20 Claims, 4 Drawing Sheets

(51) Int. Cl.
*F01N 13/00* (2010.01)
*F01N 1/00* (2006.01)
*F01N 1/24* (2006.01)

(52) U.S. Cl.
CPC ..... *F01N 2470/02* (2013.01); *F01N 2470/04* (2013.01); *F01N 2470/20* (2013.01); *F01N 2490/00* (2013.01); *F01N 2490/18* (2013.01)

(56) References Cited

U.S. PATENT DOCUMENTS

| | | | | | |
|---|---|---|---|---|---|
| 3,375,898 | A | * | 4/1968 | Von Hoevel | 181/238 |
| 3,710,891 | A | * | 1/1973 | Flugger | 181/256 |
| 4,102,430 | A | | 7/1978 | Wilson | |
| 4,116,303 | A | * | 9/1978 | Trudell | 181/252 |
| 4,192,402 | A | * | 3/1980 | Nakagawa et al. | 181/256 |
| 4,263,981 | A | * | 4/1981 | Weiss et al. | 181/252 |
| 4,278,147 | A | * | 7/1981 | Watanabe et al. | 181/256 |
| 4,779,703 | A | * | 10/1988 | Takiguchi et al. | 181/228 |
| 5,183,977 | A | * | 2/1993 | Horitani | 181/266 |
| 5,979,583 | A | * | 11/1999 | Amino et al. | 180/219 |
| 7,004,283 | B2 | * | 2/2006 | Worner et al. | 181/239 |
| 7,503,427 | B2 | * | 3/2009 | Toyoshima | 181/272 |
| 7,669,693 | B2 | * | 3/2010 | Yamaguchi et al. | 181/255 |
| 8,051,949 | B2 | * | 11/2011 | Henke et al. | 181/251 |
| 8,172,039 | B2 | * | 5/2012 | Park et al. | 181/256 |
| 8,196,702 | B2 | * | 6/2012 | Park et al. | 181/239 |
| 8,205,713 | B2 | * | 6/2012 | Gorke et al. | 181/212 |
| 8,205,716 | B2 | * | 6/2012 | Wirth | 181/269 |
| 8,579,077 | B2 | * | 11/2013 | Ahn et al. | 181/256 |
| 8,602,157 | B2 | * | 12/2013 | Luttig et al. | 181/227 |
| 2006/0219476 | A1 | | 10/2006 | Southway et al. | |
| 2007/0144828 | A1 | | 6/2007 | Galligan | |
| 2010/0192880 | A1 | | 8/2010 | Koyanagi et al. | |
| 2011/0192676 | A1 | * | 8/2011 | Wirth | 181/227 |

FOREIGN PATENT DOCUMENTS

| | | | | | |
|---|---|---|---|---|---|
| DE | 4140429 | A1 | * | 6/1993 | F01N 1/10 |
| DE | 200 11 756 | U1 | | 11/2000 | |
| DE | 102 12 050 | A1 | | 10/2003 | |
| DE | 20 2008 005 168 | U1 | | 10/2009 | |
| DE | 10 2010 008 403 | A1 | | 8/2011 | |
| EP | 1 010 868 | A2 | | 6/2000 | |
| JP | 02238115 | A | * | 9/1990 | F01N 7/16 |
| JP | 04081507 | A | * | 3/1992 | F01N 1/08 |

* cited by examiner

A - A

MUFFLER HAVING COUPLING OF A TAILPIPE BY MEANS OF A COUPLING CHAMBER

FIELD OF THE INVENTION

The invention relates to a muffler for an exhaust system of an internal combustion engine comprising a muffler housing having a housing wall with at least one inlet pipe guided through the housing wall and at least one outlet pipe guided through the housing wall, whereby the inlet pipe has at least one outflow opening through which the exhaust gas can flow out of the inlet pipe into the outlet pipe. The outflow opening can have any known shape, therefore including one formed as a perforation zone with any number of outlets of equal or different size.

BACKGROUND OF THE INVENTION

A muffler from US 2006/0219476 A1 is already known, which consists of a muffler housing with inlet pipes coupled thereto and a tail pipe arranged therein and provided with a perforation. Within the tail pipe, another exhaust pipe is arranged, which also has a perforation and is used for discharging the exhaust gas.

EP 1 010 868 A2 discloses a shell muffler formed of an upper shell, a lower shell and two intermediate shells sandwiched in between. The two intermediate shells define a partial volume, within which the inlet pipe and the outlet pipe discharge.

From DE 102 12 050 A1, a rear muffler for an exhaust system of an internal combustion engine is known, which comprises a housing having a plurality of chambers. In a first chamber downstream, at least one exhaust gas inlet pipe is inserted, while in the other chambers, exhaust gas outlet pipes flow in and are lead our from the housing. The additional chambers in each case have a lining with glass wool. The pipe ends of the exhaust gas outlet pipes are surrounded on all sides by an open space lined with glass wool in order to prevent heat marks.

SUMMARY OF THE INVENTION

The invention has the object of designing and arranging a muffler such that improved acoustic properties are ensured.

The object is achieved according to the invention in that within the muffler housing, at least one coupling chamber with a chamber wall is provided with a central axis, in which the inlet pipe and the outlet pipe discharge, whereby the chamber wall, in conjunction with the inlet pipe and the outlet pipe, forms a flow passage between the outflow opening of the inlet pipe and the inlet opening of the outlet pipe or, respectively, the outflow opening of the inlet pipe connects in a fluidly-optimised manner to the inlet opening of the outlet tube, whereby said chamber wall encircles the inlet pipe or the outlet pipe with respect to the central axis in the circumferential direction U, and the chamber wall is connected, indirectly, at least via the inlet pipe or the outlet pipe or the muffler housing intermediate wall to the housing wall in a form- or material-fitting or mechanical manner, wherein the chamber wall of the coupling chamber has a diameter D, and the exhaust pipe has an outer diameter d, whereby for the ratio of D/d, the following condition applies: 30/10>=D/d>=11/10 or 20/10>=D/d>=11/10 or 18/10>=D/d>=11/10. Thereby, it is achieved, among other things, that the inlet pipe is in fluid communication with the outlet pipe via the coupling chamber or the flow channel thus formed, and the exhaust gas from the outflow opening of the inlet pipe is conducted in the coupling chamber which is itself separated from the muffler housing or, respectively, the flow channel, and is at least partially conducted from there in the outlet pipe.

The aforementioned condition for the ratio of D/d specifically includes the individual values, i.e. D/d~11/10, 12/10, 13/10 14/10, 15/10, 16/10, 17/10, 18/10, 19/10, 20/10, 21/10 22/10, 23/10, 24/10 25/10, 26/10, 27/10, 28/10 and 29/10. On the one hand, it is necessary to limit the distance between the exhaust pipe and the chamber wall, so that the desired acoustic effect of an extended outlet pipe is achieved. A minimum distance is also necessary so that the acoustic effect of an outlet pipe which is as long as possible is accomplished. The claimed diameter ratio ensures the formation of an optimal gap or, respectively, flow channel between the chamber wall of the coupling chamber and the inlet pipe. The degree of magnification is determined by the acoustic effect that can be achieved as a result of the acoustic extension or enlargement of the effect size or effect length underlying the outlet pipe.

For coupling chambers comprising a chamber wall which has a non-circular cross-sectional shape Q, instead of the diameter D, an average diameter D' is to be used as the basis for the calculation of the diameter ratio D/d or, respectively, D'/d.

Characteristic of the coupling chamber is a chamber wall which surrounds the inlet pipe at a distance. Thus, the flow channel is formed between the inlet pipe and the chamber wall. Via the flow channel, the exhaust gas leads from the outflow opening or, respectively, the perforation zone of the intake pipe to the inlet opening of the outlet pipe. In the variation, in which the inlet pipe is disposed within the coupling chamber, the coupling chamber or, respectively, the coupling chamber wall forms the radially outer part of the flow channel while the inlet pipe forms the radially inner part of the flow channel. In the axial direction, the coupling chamber is delimited by a collar or, respectively, a front wall of the coupling chamber wall or a part of a muffler housing intermediate wall. In this case, the muffler housing intermediate wall forms a part of the coupling chamber wall. The coupling chamber or, respectively, the chamber wall thus seals off the outflow opening of the inlet pipe which discharges into the coupling chamber relative to the other muffler housing, so that the exhaust gas is led to/into the outlet pipe which likewise discharges into the coupling chamber. The chamber wall may also be provided with a perforation, such that the coupling chamber is coupled to the space surrounding it. This coupling is essentially acoustic in nature, since no appreciable exhaust gas flow takes place in this closed space. More outflow openings or, respectively, perforation zones of the inlet and/or outlet pipe which discharge into another coupling chamber or elsewhere in the muffler housing are of course possible.

Thus, it is also ensured that the effective acoustic length of the outlet pipe is increased by the volume of the coupling chamber, such that significant acoustic advantages are provided. The latter in particular is relevant for the development of sport mufflers.

By enclosing the exhaust pipe, the size of the thus formed flow channel, and thereby its length, is extended. Additionally or alternatively, for the purpose of increasing the flow channel, the coupling chamber can also be varied in size in the axial direction to the inlet pipe.

By varying the size or, respectively, the geometry of the coupling chamber, this acoustic effect can be arranged almost at will.

The muffler housing can be designed as a pipe closed at the end or even formed by two half shells.

For this purpose, it may be advantageous if the flow channel is bounded by the inlet pipe, the outlet pipe, and a) the chamber wall alone or b) the chamber wall and a part of a muffler housing intermediate wall or c) the chamber wall and two parts of two muffler housing intermediate walls.

In addition to a very good acoustic behaviour, this can afford a simple structure, thus ensuring easy installation. The coupling chamber extends in relation to the direction of the central axis over only part of the inlet pipe length or of the outlet pipe, and in order to limit the length l of the coupling chamber, the chamber wall has a collar, which is connected to the inlet pipe and/or the outlet pipe. In the collar, a pass-through hole is only provided for the exhaust pipe, such that the coupling chamber can be mounted and/or installed together with the respective exhaust pipe. Alternatively, if an intermediate wall attached to a wall of the housing is provided in the muffler housing, the chamber wall can be connected to said intermediate wall. Installation then occurs together with the intermediate wall, which is to be installed anyway. In both cases, a simple pre-assembly of the components is possible, which are then inserted and fixed in the (for example) cylindrical muffler housing.

It can also be advantageous in this case if the chamber wall has a circular, oval, polygonal, or multi-sided cross-sectional shape Q with a central axis. The central axis is preferably parallel or coaxially arranged in relation to the centre axis of the inlet pipe. Thus, symmetrical position conditions exist that create simplified manufacturing.

In addition, it may be advantageous if the respective outflow openings are formed as a perforation zone, wherein the perforation zone comprises a plurality of holes with a width s and an average width s of the holes of the outflow opening satisfy the following condition: 2 mm<=s<=6 mm or 2.5 mm<=s<=4.5 mm or 3 mm<=s<=3.5 mm. On the basis of the average exhaust gas flow, extremely good acoustic characteristics can be obtained with the outflow openings of these sizes. In general, the holes of the outflow openings are all equal. If outflow openings of a different size or width are used, then the average width s relates to all outflow openings of a perforation zone.

In principle, it may also be advantageous if the inlet pipe or the outlet pipe has a flow cross section A and a plurality of outflow openings in the form of at least one perforation zone having an opening cross-section Ai, wherein the opening cross-section Ai in a coupling chamber and the flow cross section A meet the following condition: Ai<=3 A or Ai<=2.5 A or Ai<=2 A. Thus, a flow velocity in the outflow opening which is below the threshold for flow noise is guaranteed. It may also be advantageous if each outlet pipe is coupled via a separate coupling chamber to the inlet pipe, or a plurality of outlet pipes are connected via a coupling chamber to the inlet pipe. Depending on whether only one or several outlet pipes are connected to the respective coupling chamber, the size and the axial extent of the coupling chamber can be selected. A coupling chamber which accommodates a plurality of juxtaposed outlet pipes with respect to the length of the inlet pipe is, in principle, to be formed as a coupling chamber which only accommodates one outlet pipe. The same applies in the case that the outlet pipes are arranged in the circumferential direction U of the inlet pipe. In this case, it depends on the axial dimension of the coupling chamber, i.e. not on the direction of the central axis. It can also depend on a plurality of outlet pipes radially disposed to the central axis in a star-like or radiating form, so to speak, which are connect to a coupling chamber. This ultimately presupposes, however, that the coupling chamber then also extends in the circumferential direction U, so that the outlet pipes can be arranged in the circumferential direction U. The structure of the other inner space of the muffler housing is initially independent of the presence of the coupling chamber. Experience has shown that it can be advantageous if the interior which surrounds the coupling chamber is completely or at least partially filled with a damping means, in terms of a first space. This ensures the use of perforation zones at the outlet pipe itself, such that the outlet pipe is acoustically coupled to said interior space or, respectively, the first space. Should this space be designed without damping means, other common forms of design could be applied there for sound reflection. In addition, it may be advantageously provided that the muffler housing defines an interior space having at least a first space, in which the coupling chamber and the outlet pipe which is arranged on it are connected, whereby the first space is provided with or without damping means. Depending on whether the muffler is based on the reflection or absorption principle, the damping means are provided in the first space.

It can be of particular importance for the present invention that in the interior space, at least a first intermediate wall and an additional space limited by the intermediate wall and the muffler housing is provided and that the inlet pipe has a further outflow opening or perforation zone, whereby the further perforation zone is located within the second space and the second space is optionally filled with damping means. In addition to the use of coupling chambers for connecting the outlet pipe to the inlet pipe in a fluidly-optimised manner, the acoustical property of the muffler can also be improved overall by a part of the intake pipe being connected to the interior of the muffler housing or, respectively, to a second space of the muffler housing via a second outflow opening or, respectively, a perforation zone. Optionally, a plurality of such outflow openings or perforation zones can also be provided along the length of the inlet pipe, through which the inlet pipe is at least acoustically coupled to the interior. Depending on whether the respective space is based on the reflection or absorption principle, damping means are provided therein.

In addition, it can be advantageous if, in the intermediate space, at least a second intermediate wall and a third space delimited by the intermediate wall and the muffler housing are provided, and that the inlet pipe has a further outflow opening, whereby the further outflow opening is located within said third space and the third space is, optionally, at least partially filled with damping means. The damping properties will thus be further improved overall.

In connection with the construction and arrangement according to the invention, it can be advantageous if the chamber wall of the coupling chamber is closed or at least one or more coupling openings or a perforation zone is provided, via which the coupling chamber is coupled at least acoustically to the first space. The coupling chamber itself may be closed or also formed with a perforation zone for the purpose of connection to the interior space. The latter is crucial in the choice of the acoustic behaviour as a whole. This concerns both the number as well as the size of the openings for this perforation zone of the individual coupling chamber. In principle, a mixture of coupling chambers with and without perforation zones may be provided. This selection is, as mentioned above, made according to the type of acoustic behaviour thus achieved.

It may also be advantageous if the first intermediate wall has at least one or more coupling openings or, respectively, a perforation zone. If the interior space is filled with damping means, the application of a perforation zone of the respective separating interior wall also presents a further means to influence the acoustics of the muffler overall. Thereby, the number of interior walls on the one hand and the development of perforation zones on the other hand can be freely selected in order to accomplish the desired acoustic result. This also applies to the number of chambers, or even the outlet pipes, which are arranged respectively in the first, second or a further space formed by intermediate walls inside the muffler housing.

The object is also achieved by an engine with an above-delineated muffler in which the middle width s of the holes of the outflow opening and the opening cross-section Ai of all the holes or outflow openings are selected, such that at the maximum mass flow and at the full load of the engine, a Mach number of max. 0.25 to 0.3 is achieved in the holes of the outflow openings. This preferably applies for all holes and/or outflow openings whereby at least most of the holes of the outflow openings should be concerned. Assuming a constant gas flow rate, the flow velocity within the hole is basically determined through the average width s and/or the size and number of the provided opening cross-section Ai of the outflow opening or, respectively, of all the holes on the one hand and the flow cross-section A of the inlet pipe on the other.

BRIEF DESCRIPTION OF THE DRAWINGS

Further advantages and details of the invention are described in the patent claims and the specification and illustrated in the figures. These show the following:

DETAILED DESCRIPTION OF THE INVENTION

Figure 1:
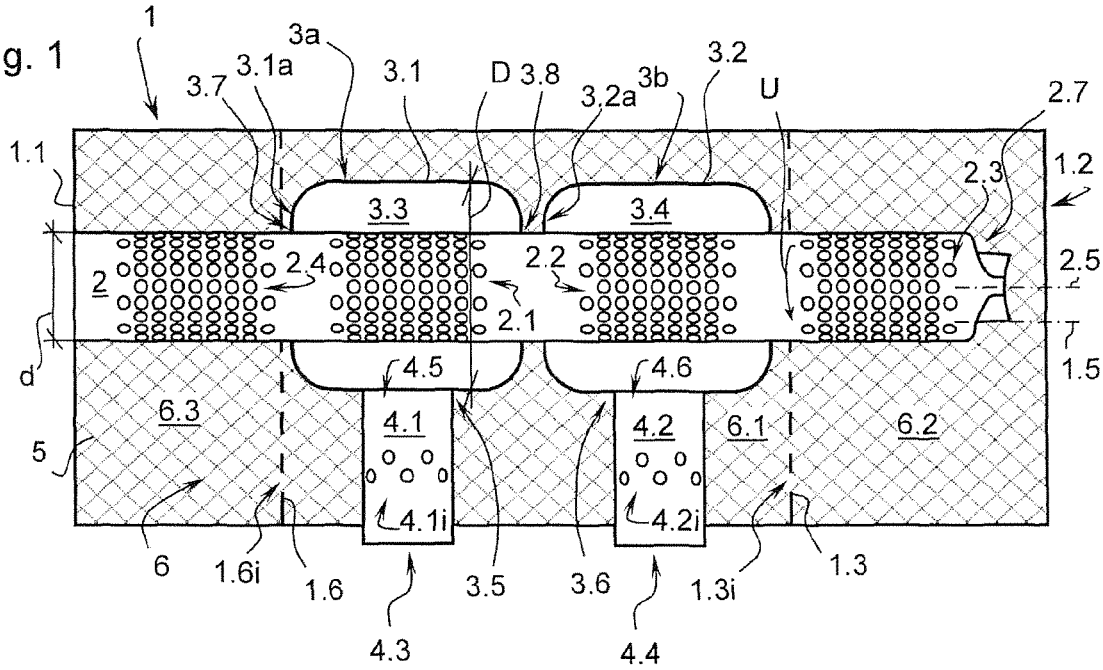
FIG. 1 Cross-sectional view of a muffler with a coupling chamber.

A muffler illustrated in FIG. 1 has a muffler housing 1.2 with a housing wall 1.1. The housing wall 1.1 defines an interior space 6, in which an inlet pipe 2 with the outflow openings 2.1, 2.2 and two outlet pipes 4.1, 4.2 are shown, each with an inlet opening 4.5, 4.6. The inlet pipe 2 and the outlet pipe 4.1, 4.2 discharge via the outflow opening 2.1, 2.2 or, respectively, via the inlet pipe 4.5, 4.6 into the coupling chamber 3*a*, 3*b*. The coupling chamber 3*a*, 3*b*, together with the inlet pipe 2 and the respective outlet pipe 4.1, 4.2, forms a flow channel 3.3, 3.4 of the outflow opening 2.1, 2.2 of the inlet pipe 2 to the inlet opening 4.5, 4.6 of the outlet pipe.

The inlet pipe 2 is guided in the axial direction to a centre axis 1.5 of the muffler housing 1.2 through the housing wall 1.1 and mounted with an open end 2.6 within the housing wall 1.1. The inlet pipe 2 has four outflow openings 2.1-2.4 which are designed as perforation zones, with the space of all outflow openings 2.1-2.4, whereby the space of all outflow openings 2.1-2.4, i.e. the opening cross-section Ai of the perforation zones 2.1-2.4 within a coupling chamber 3*a*, 3*b* is larger by a factor of approximately 2.5 than is a flow cross-section A of the inlet pipe 2. An end 2.7 of the inlet pipe 2 opposite the inlet opening 2.6 is closed by means of reshaping.

The muffler housing 1.2 has two intermediate walls 1.3, 1.6 which divide the inner space 6 into a first space 6.1, a further space 6.2 and a third space 6.3. The respective interior wall 1.3, 1.6 has a plurality of coupling openings 1.3*i*, 1.6*i*, via which the three spaces 6.1-6.3 are acoustically coupled.

Within the interior space 6, a damping means 5, such as e-glass, is provided, and the respective space 6.1-6.3 is at least partially filled with the damping means 5.

The two outlet pipes 4.1, 4.2 are arranged within the first space 6.1. The outlet pipes 4.1, 4.2 are mounted on its outlet end 4.3, 4.4 within the housing wall 1.1. In the space of the inlet pipe 2, the respective outlet pipe 4.1, 4.2 is coupled or mechanically connected via the coupling chamber 3*a*, 3*b* to the inlet pipe 2. Each coupling chamber 3*a*, 3*b* includes a chamber wall 3.1, 3.2, the diameter D of which is approximately 60% greater than an outer diameter d of the inlet pipe 2. The chamber wall 3.1 surrounds the inlet pipe 2 in a circumferential direction U of the inlet pipe 2 and has a first recess 3.5, 3.6 in which the respective outlet pipe 4.1, 4.2 is connected to the coupling chamber 3*a*, 3*b*.

Furthermore, the respective coupling chamber 3*a*, 3*b* has a collar 3.1*a*, 3.2*a* which is radially directed inward on the front side and has a hole 3.7, 3.8, via which the inlet pipe 2 is guided through the two parts of the chamber wall 3.1, 3.2 which are disposed successively in an axial direction. The collar 3.1*a*, 3.2*a* thereby forms, so to speak, the axial end of the coupling chamber 3*a*, 3*b*.

Each coupling chamber 3*a*, 3*b* has a cylindrical shape in light of the above-defined diameter D and receives the likewise cylindrically shaped inlet pipe 2 that has a slightly smaller outer diameter d.

Consequently, a centre axis 2.5 of the inlet pipe 2 and a centre axis 2.5 of the respective coupling chamber 3*a*, 3*b* are identical.

Each coupling chamber 3*a*, 3*b* is arranged in the region of a perforation zone 2.1, 2.2, such that an exhaust gas stream emerging from the respective perforation zone 2.1, 2.2 is lead into the outlet pipe 4.1, 4.2 which is connected to the chamber wall 3.1, due to the coupling chamber 3*a*, 3*b* or, respectively, the chamber wall 3.1, 3.2 surrounding the perforation zones 2.1, 2.2. The chamber wall 3.1, 3.2 is connected to the inlet pipe 2, the latter, for example, by being pushed on the inlet pipe 2 into a designated passage opening 3.7, 3.8 within a collar 3.1*a*, 3.1*b* of the chamber wall 3.1, 3.2. The tightness between the chamber wall 3.1, 3.2 and the inlet pipe 2 is not necessarily important, especially if the chamber wall 3.1, 3.2 has coupling openings 3.1*i*, 3.2*i* in the form of perforation zones pursuant to FIG. 3.

The exhaust gas emerging from the respective perforation zone 2.1, 2.2 is thus lead into the respective outlet pipe 4.1, 4.2 via the coupling chamber 3*a*, 3*b* or, respectively, a flow channel 3.3, 3.4 formed between the inlet pipe 2 and the coupling chamber 3*a*, 3*b*.

The outflow openings 2.1, 2.2 are formed by a plurality of holes 2.8 each having an average width s (see, for example, FIG. 7) between 3 mm and 3.5 mm.

Here, the inlet pipe 2 has a flow cross-section A (see, for example, FIG. 8*b*) and a perforation zone 2.1, 2.2 formed by a plurality of holes 2.8 with a common opening cross-section Ai (see, for example, FIG. 2), which is formed by the sum of the holes of the outflow openings 2.1, 2.2. The flow cross-section A is at a maximum 2.5 times greater than the opening cross-section Ai of the outflow openings 2.1, 2.2 within the one coupling chamber 3*a*, 3*b*. Within the other space 6.2 or, respectively, the third space 6.3, neither an outlet pipe 4.1, 4.2 nor a coupling chamber 3*a*, 3*b* is provided. Via the respective perforation zone 2.3, 2.4, the inlet pipe 2 is coupled to the space 6.2, 6.3. This coupling is transmitted through the above-mentioned coupling openings 1.3*i*, 1.6*i* of the respective intermediate wall 1.3, 1.6 in the three spaces 6.1-6.3.

Figure 2:
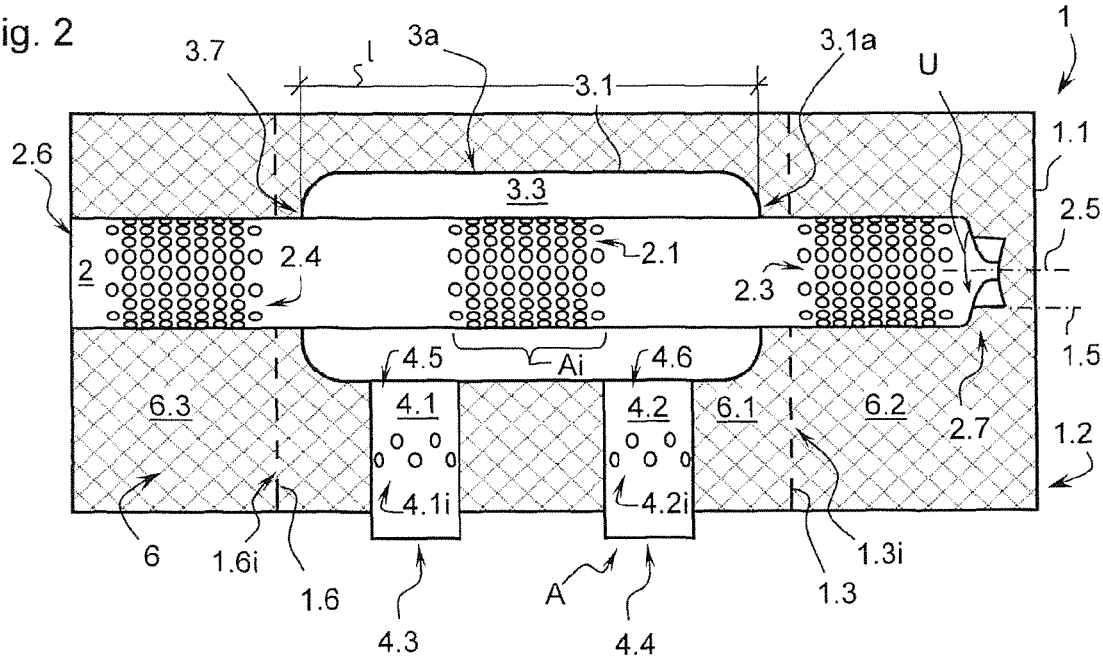
FIG. 2 Cross-sectional view of a muffler with a coupling chamber.

According to exemplary embodiment FIG. 2, the two exhaust pipes 4.1, 4.2 are coupled via a common coupling chamber 3*a* to the inlet pipe 2. The coupling chamber 3*a* extends in the axial direction of the central axis 2.5 over the one perforation zone 2.1 and seals this off against exhaust gas in relation to the first space 6.1. Thus, the above-mentioned ratio of 2.5 between the flow cross-section A and the opening cross-section Ai is constant. The exhaust gas emerging from the one perforation zone 2.1 is thus passed through the coupling chamber 3*a* in the two outlet pipes 4.1, 4.2. The inlet pipe 2 and both exhaust pipes 4.1, 4.2 discharge via the outflow opening 2.1, 2.2 or, respectively, via the inlet openings 4.5, 4.6 in the coupling chamber 3*a*.

The coupling chamber 3*a*, together with the inlet pipe 2 and the two outlet pipes 4.1, 4.2, forms a flow channel 3.3 from the outflow opening 2.1 of the inlet pipe 2 to the inlet openings 4.5, 4.6 of the outlet pipes.

Figure 3:
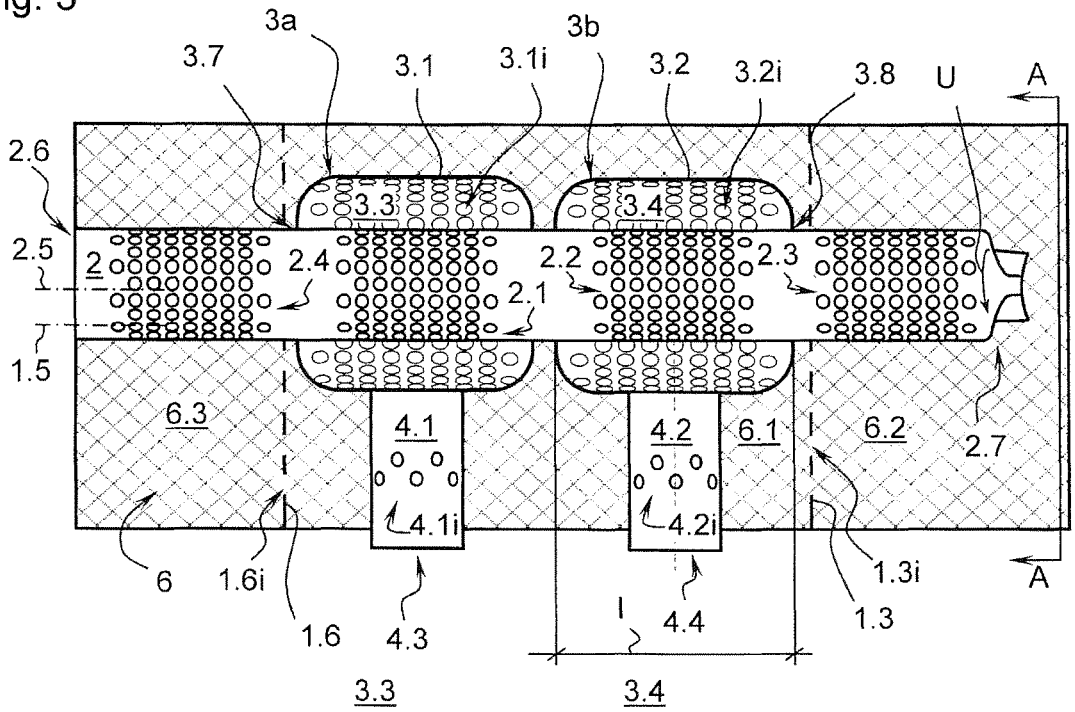
FIG. 3 Cross-sectional view of a muffler with a coupling chamber.

According to FIG. 3, the respective outlet pipe 4.1, 4.2 is, analogous to FIG. 1, connected separately to the inlet pipe 2 via the coupling chamber 3*a*, 3*b* in the space of the respective perforation zone 2.1, 2.2. The coupling chamber 3*a*, 3*b* does not seal off the perforation zone 2.1, 2.2 in relation to the first space 6.1, though. The chamber wall 3.1, 3.2 comprises a plurality of coupling openings 3.1*i*, 3.2*i*, via which the coupling chamber 3*a*, 3*b* is coupled to the first space 6.1. Here, as well, the coupling chamber 3*a*, 3*b* together with the inlet pipe 2 and the respective outlet pipe 4.1, 4.2 form a flow channel 3.3, 3.4 from the outflow opening 2.1, 2.2 of the inlet pipe 2 to the inlet opening 4.5, 4.6 of the outlet pipe.

In principle, it is also possible to provide a common coupling chamber 3*a* pursuant to FIG. 2 with corresponding coupling openings 3.1*i*. The size and number of the coupling openings 3.1*i* or, respectively, the size and design of the respective coupling opening or, respectively, the perforation zone 2.1 of the inlet pipe 2 are hereby to be designed overall according to the desired acoustic performance of muffler 1.

The same applies to the ratio of the diameter D of the respective coupling chamber 3*a*, 3*b* to the diameter d of the inlet pipe 2 as well as to the respective length l of the coupling chamber 3*a*, 3*b*, which is limited overall at least by the distance between the two chamber walls 1.3, 1.6 or, respectively, the length of the muffler housing 1.2.

As the ratio between the diameter D of the chamber wall 3.1, 3.2 of the coupling chamber 3*a*, 3*b* to the outer diameter d of the inlet pipe 2, a value of about 16/10 is currently provided.

With the use of only one chamber wall 1.3 or a correspondingly shaped chamber wall 1.3, the length l of each coupling chamber 3*a*, 3*b* can be extended overall corresponding to the size and/or length of the muffler 1.

The respective outlet pipe 4.1, 4.2 also includes coupling openings 4.1*i*, 4.2*i* and is thus part of the coupling system, consisting of perforation zones 2.3, 2.4 and coupling openings 1.3*i*, 1.6*i* of the intermediate walls 1.3, 1.6.

Figure 4:
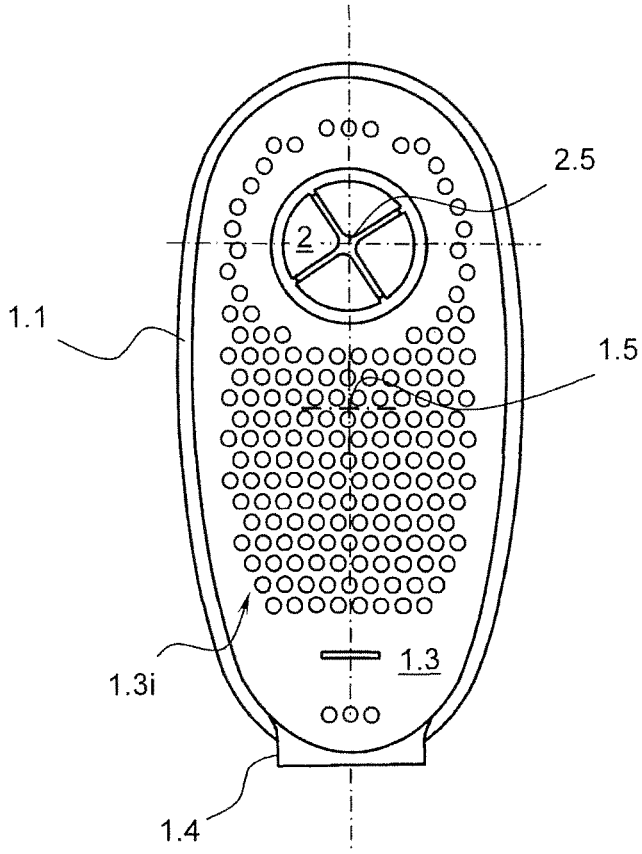
FIG. 4 Cross-sectional view of a muffler with a coupling chamber.

In the side view in FIG. 4, the chamber wall 1.3 is optionally presented with a plurality of coupling openings 1.3*i*. At the lower end of the muffler housing 1.2, a dome 1.4 is to be see, which serves as a depository for the outlet pipe 4.2.

Figure 5:
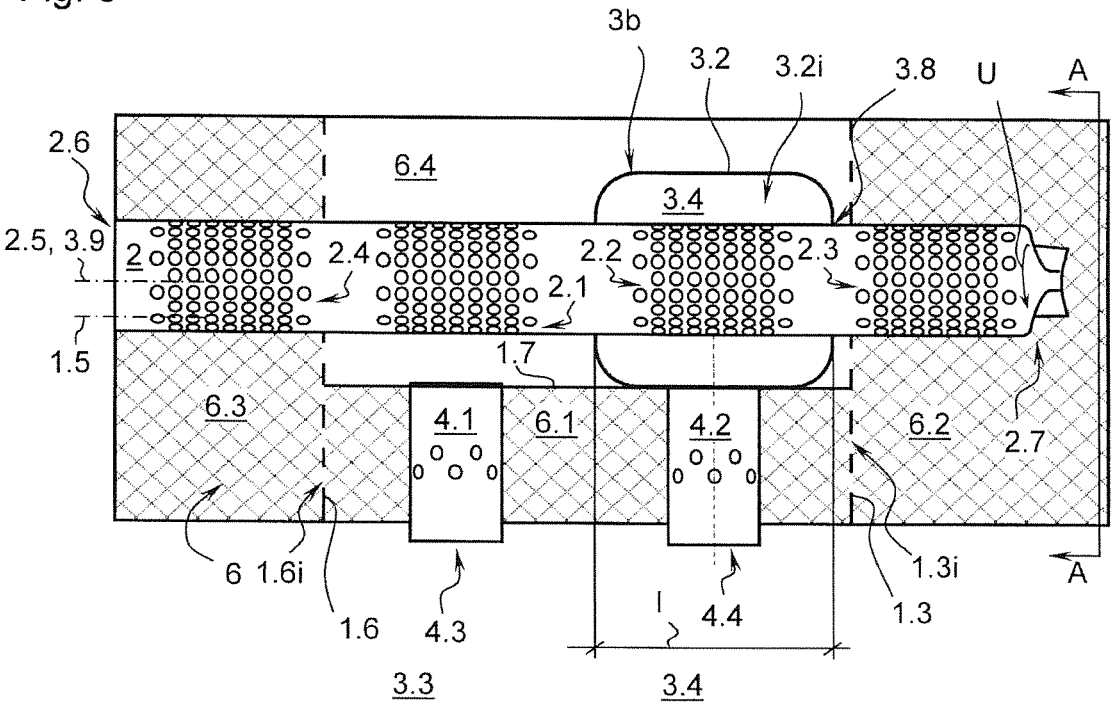
FIG. 5 Cross-sectional view of a muffler with a coupling chamber.

According to exemplary embodiment FIG. 5, another intermediate wall 1.7 extending parallel to the centre axis 1.5 is provided, which extends from the intermediate wall 1.6 to the intermediate wall 1.3. It limits a fourth space 6.4 of the muffler housing 1.2, which does not contain any damping means 5. The coupling chamber 3*b* is formed without coupling openings 3.2*i* and forms, within the fourth space 6.4, a flow channel 3.4 which is closed off to this extent. Above the perforation zones 2.1, there is the inlet pipe 2 directly in fluid communication with the fourth space 6.4 and the outlet pipe 4.1. The fourth space 6.4 is coupled via the coupling openings 1.6*i*, 1.3*i* of the intermediate wall 1.6, 1.3 with the third or, respectively, second space 6.3, 6.2.

Figure 6:
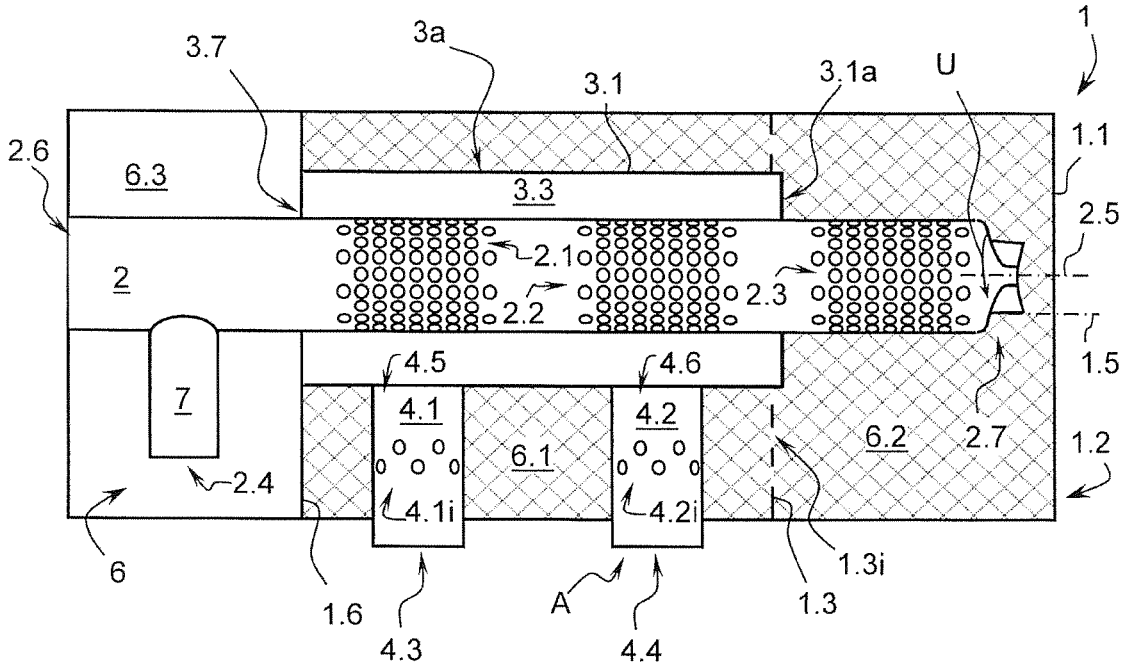
FIG. 6 Cross-sectional view of a muffler with a coupling chamber.

According to exemplary embodiment FIG. 6, based on exemplary embodiment FIG. 2, the third space 6.3 is equipped without damping means 5. Instead of the perforation zone 2.4, the inlet pipe 2 has a pipe socket 7 with the outflow opening 2.4, via which the inlet pipe 2 communicates with the third space 6.3. The chamber wall 3.1 of the coupling chamber 3*a* is connected to the left side of the closed partition wall 1.6, such that the chamber wall 3.1 is formed by a part of the partition wall 1.6 and/or the flow channel 3.3 is bordered by a part of the partition wall 1.6. To the right side, the coupling chamber 3*a* has the collar 3*a*, which is connected to the inlet pipe 2. The chamber wall 3.1 is led through the partition wall 1.3. The inlet pipe 2 and the outlet pipes 4.1, 4.2 discharge via the outflow opening 2.1, 2.2 or, respectively, via the inlet openings 4.5, 4.6 in the coupling chamber 3*a*, 3*b*. The coupling chamber 3*a*, together with the intermediate wall 1.6, the inlet pipe 2 and the two outlet pipes 4.1, 4.2, forms a flow channel 3.3 from the outflow opening 2.1 of the inlet pipe 2 to the inlet openings 4.5, 4.6 of the outlet pipes.

Figure 7:
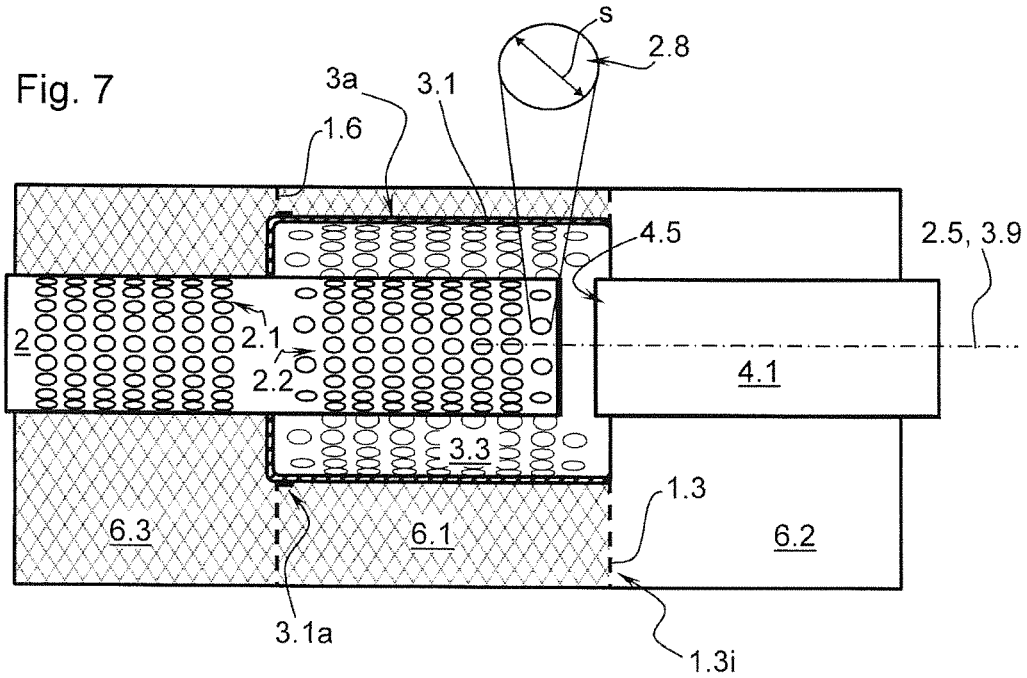
FIG. 7 Cross-sectional view of a muffler with a coupling chamber.

According to exemplary embodiment FIG. 7, the outlet pipe 4.1 is located coaxially to the inlet pipe 2 on the one hand and coaxially to the chamber wall 3.1 on the other. The coupling chamber 3*a* is limited in the space of the outlet pipe 4.1 by a part of the partition wall 1.3, as already described in the exemplary embodiment on the left side in FIG. 6. This part of the partition wall 1.3 also serves as a depository for the outlet pipe 4.1. In the region of the intermediate wall 1.6, the chamber wall 3.1 has the collar 3.1*a*, which is connected to the inlet pipe 2. Accordingly, the chamber wall 3.1 in the space of the chamber wall diameter is incorporated into the intermediate wall 1.6. The inlet pipe 2 is closed at the front end within the coupling chamber 3*a*, such that the exhaust gas stream flows from the perforation zone 2.2 into the coupling chamber 3*a* or, respectively, into the flow channel 3.3, and from there out, at least indirectly, via the outlet pipe 4.1.

The inlet pipe 2 and the outlet pipe 4.1 discharge via the outflow opening 2.1 or, respectively, via the inlet opening 4.5, in the coupling chamber 3*a*. The coupling chamber 3*a*, together with the intermediate wall 1.3, the inlet pipe 2 and the outlet pipe 4.1, forms a flow channel 3.3 from the outflow opening 2.2 of the inlet pipe 2 to the inlet opening 4.5 of the outlet pipe 4.1. The second space 6.2 is not filled with the damping means 5. Via the coupling opening 1.3*i*, it communicates with the first space 6.1.

The respective hole 2.8 of the respective outflow opening 2.2 has a mean width s of about 3 mm to 3.5 mm.

Figure 8A:
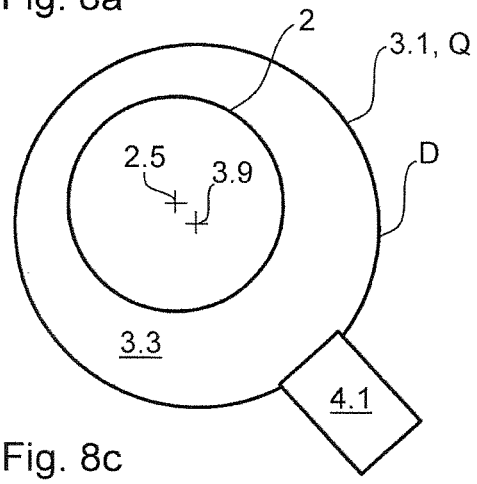
FIG. 8*a* Schematic diagram of the cross-sectional shape of the coupling chamber.
Figure 8B:
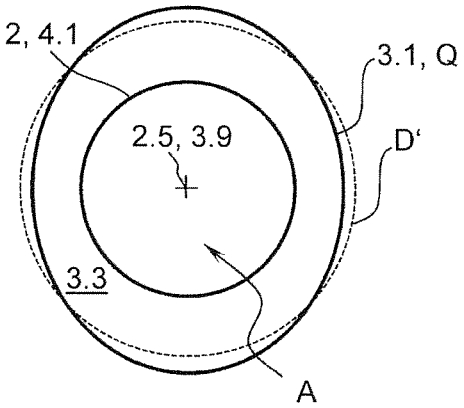
FIG. 8*b* Schematic diagram of the cross-sectional shape of the coupling chamber.
Figure 8C:
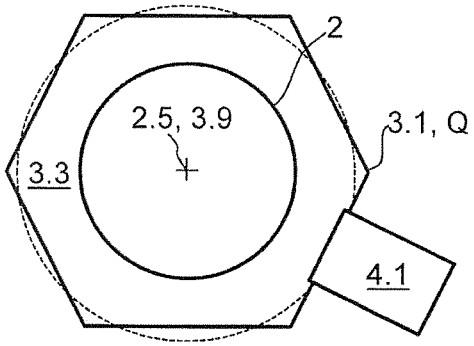
FIG. 8*c* Schematic diagram of the cross-sectional shape of the coupling chamber.

According to FIGS. 8*a*-8*c*, the chamber wall 3.1 can have a circular, round, oval, polygonal, such as a hexagonal, cross-sectional shape Q. According to FIG. 8*a*, the chamber wall 3.1 and the inlet pipe 2, in contrast to the exemplary embodiments according to FIGS. 1-7, 8*b* and 8*c*, are not arranged coaxially, i.e. the centre axis 2.5 of the inlet pipe 2 is offset from the centre axis 3.9 of the coupling chamber 3*a*. Thus, the width of the flow channel 3.3 is non-uniform in relation to the circumference U, such that the distance between the inlet pipe 2 and the outlet pipe 4.1 is enlarged, for example, whereby the acoustic properties are changed. Other configurations, such as a reduced spacing in the space of the outlet pipe 4.1, are also possible. According to FIG. 8*b*, the outlet pipe 4.1 is also arranged coaxially to the inlet pipe 2.

According to FIGS. 8*b* and 8*c*, the respective chamber wall 3.1, irrespective of its cross-sectional shape Q, which deviates from the circular form, has an average diameter D', which serves as a basis for the calculation of the diameter ratio D/d in relation to the diameter D of the inlet pipe 2.

LIST OR REFERENCE NUMERALS

1 Muffler
1.1 Housing wall
1.2 Muffler housing
1.3 First intermediate wall, muffler housing intermediate wall
  1.3*i* Coupling opening
1.4 Dome
1.5 Central axis
1.6 Second intermediate wall
1.6*i* Coupling opening
1.7 Intermediate wall
2 Inlet pipe
2.1 Outflow opening, perforation zone
2.2 Outflow opening, perforation zone
2.3 Outflow opening, perforation zone
2.4 Outflow opening, perforation zone
2.5 Central axis
2.6 Open end, inlet pipe
2.7 Opposite end
2.8 Hole
3*a* Coupling chamber
3*b* Coupling chamber
3.1 Chamber wall
3.1*a* Collar
3.1*i* Coupling aperture
3.2 Chamber wall
3.2*a* Collar
3.2*i* Coupling opening
3.3 Flow channel
3.4 Flow channel
3.5 Recess for 4.1
3.6 Recess for 4.1
3.7 Pass-through hole for 2
3.8 Pass-through hole for 2
3.9 Central axis
4.1 Outlet pipe
4.11 Coupling opening
4.2 Outlet pipe
4.2*i* Coupling opening
4.3 Outlet end
4.4 Outlet end
4.5 Inlet opening
4.6 Inlet opening
5 Dampening means
6 Interior space
6.1 First space, partial volume
6.2 Other space, second space
6.3 Third space
6.4 Fourth space
7 Pipe socket
A Outlet cross-section, flow cross-section
Ai Opening cross-section
D Average diameter
D' Average diameter
d Outside diameter
l Length of 3*a*, 3*b*
Q Cross-sectional shape of 3.1
s Average width
U Circumferential direction, circumference

What is claimed is:

1. A muffler for an exhaust gas system of an internal combustion engine, comprising: a muffler housing having a housing wall, having at least one muffler housing intermediate wall, having at least one inlet pipe guided through the housing wall and having at least one outlet pipe guided through the housing wall, whereby the inlet pipe has at least one outflow opening, via which the exhaust gas can flow from the inlet pipe to the outlet pipe, within the muffler housing, at least one coupling chamber is provided having a central axis and having a chamber wall, in which the inlet pipe and the outlet pipe discharge, the chamber wall being spaced apart from the housing wall whereby the chamber wall, which is different from the housing wall, together with the inlet pipe and the outlet pipe, forms a flow channel from the inlet pipe to the outlet pipe, whereby the chamber wall surrounds the inlet pipe or the outlet pipe with respect to the central axis in a circumferential direction U, and the chamber wall is connected only indirectly over at least the inlet pipe or the outlet pipe or the muffler housing intermediate wall with the housing wall, whereby the chamber wall of the coupling chamber has a diameter D, and the inlet pipe and the outlet pipe each have an outer diameter d, whereby for the ratio D/d, 20/10>=D/d>=11/10 or 18/10>=D/d>=11/10 applies.

2. The muffler according to claim 1, wherein the flow channel is limited only by the inlet pipe, the outlet pipe and a) the chamber wall alone or b) the chamber wall and a part of a muffler housing intermediate wall or c) the chamber wall and two parts of two muffler housing intermediate walls.

3. The muffler according to claim 1, wherein the chamber wall has a round, oval, polygonal, or multi-sided cross-sectional shape Q with a central axis.

4. The muffler according to claim 1, wherein the respective outlet opening is designed as a perforation zone, whereby the perforation zone has a plurality of holes with a width s and a mean width s of the holes of the outflow opening fulfils the following condition:

$$2\text{ mm}<=s<=6\text{ mm or }2.5\text{ mm}<=s<=4.5\text{ mm or }3\text{ mm}<=s<=3.5\text{ mm}.$$

5. The muffler according to claim 1, wherein the inlet pipes or the outlet pipe has a flow cross-section A and a plurality of outlet openings in the form of at least one perforation zone having an opening cross-section Ai, whereby the opening cross-section Ai within a coupling chamber and the flow cross-section A meet the following condition: $Ai_{<}=3$ A or $Ai_{<}=2.5$ A or $Ai_{<}=2$ A.

6. The muffler according to claim 1, wherein each outlet pipe is coupled via a separate coupling chamber to the inlet pipe or a plurality of outlet pipes is coupled via a coupling chamber to the inlet pipe.

7. The muffler according to claim 1, wherein the muffler housing limits an interior space which has at least a first space in which the coupling chamber and the outlet pipe connected thereto are attached, whereby the first space is provided with or without the damping means.

8. The muffler according to claim 7, wherein in the interior space, at least a first intermediate wall and a further space which are limited by the intermediate wall and the muffler housing is provided, and in that the inlet pipe has a further outflow opening, whereby the further outflow opening is placed inside the second chamber and the second space, optionally, is filled at least partially with damping means.

9. The muffler according to claim 8, wherein in the interior space, at least a second intermediate wall and a third space limited by the intermediate wall and the muffler housing is provided, and in that the inlet pipe has a further outflow opening, whereby the further outflow opening is located within the third space, and the third space, optionally, is filled at least partially with damping means.

10. The muffler according to claim 7, wherein the chamber wall of the coupling chamber is closed or has at least one coupling opening, via which the coupling chamber is coupled to the first space.

11. The muffler according to claim 6, wherein the first intermediate wall has at least one coupling opening.

12. An engine having a muffler according to claim 1, wherein the average width s of the outflow openings and the opening cross-section Ai of all outflow openings are selected such that at the maximum mass flow of the engine, a Mach number in the outflow opening of max. 0.25 to 0.3 is achieved.

13. The muffler according to claim 2, wherein the chamber wall has a round, oval, polygonal, or multi-sided cross-sectional shape Q with a central axis.

14. The muffler according to claim 13, wherein the respective outlet opening is designed as a perforation zone, whereby the perforation zone has a plurality of holes with a width s and a mean width s of the holes of the outflow opening fulfils the following condition:

$$2\ \text{mm} <= s <= 6\ \text{mm or } 2.5\ \text{mm} <= s <= 4.5\ \text{mm or } 3\ \text{mm} <= s <= 3.5\ \text{mm}.$$

15. The muffler according to claim 14, wherein the inlet pipes or the outlet pipe has a flow cross-section A and a plurality of outlet openings in the form of at least one perforation zone having an opening cross-section Ai, whereby the opening cross-section Ai within a coupling chamber and the flow cross-section A meet the following condition: $Ai <= 3\ A$ or $Ai <= 2.5\ A$ or $Ai <= 2\ A$.

16. The muffler according to claim 15, wherein each outlet pipe is coupled via a separate coupling chamber to the inlet pipe or a plurality of outlet pipes is coupled via a coupling chamber to the inlet pipe.

17. The muffler according to claim 16, wherein the muffler housing limits an interior space which has at least a first space in which the coupling chamber and the outlet pipe connected thereto are attached, whereby the first space is provided with or without the damping means.

18. The muffler according to claim 17, wherein in the interior space, at least a first intermediate wall and a further space which are limited by the intermediate wall and the muffler housing is provided, and in that the inlet pipe has a further outflow opening, whereby the further outflow opening is placed inside the second chamber and the second space, optionally, is filled at least partially with damping means.

19. The muffler according to claim 18, wherein in the interior space, at least a second intermediate wall and a third space limited by the intermediate wall and the muffler housing is provided, and in that the inlet pipe has a further outflow opening, whereby the further outflow opening is located within the third space, and the third space, optionally, is filled at least partially with damping means.

20. The muffler according to claim 19, wherein the chamber wall of the coupling chamber is closed or has at least one coupling opening, via which the coupling chamber is coupled to the first space, and wherein the first intermediate wall has at least one coupling opening.

* * * * *